United States Patent [19]

Weisgerber et al.

[11] 4,156,416

[45] May 29, 1979

[54] ENGINE DRIVEN VACUUM PUMP

[75] Inventors: Thomas W. Weisgerber, Saginaw; Brian K. Nelson, Frankemuth; Richard P. Riefel, Saginaw, all of Mich.

[73] Assignee: General Motors Corporation, Detroit, Mich.

[21] Appl. No.: 831,816

[22] Filed: Sep. 9, 1977

[51] Int. Cl.[2] ..... F01M 1/00

[52] U.S. Cl. ..... 123/196 R

[58] Field of Search ..... 123/196 R; 417/259, 417/471, 48

[56] References Cited

U.S. PATENT DOCUMENTS

| | | | |
|---|---|---|---|
| 961,000 | 6/1910 | Oddie | 417/259 |
| 3,018,779 | 1/1962 | Tyler | 417/259 |

FOREIGN PATENT DOCUMENTS

| | | | |
|---|---|---|---|
| 106667 | 3/1939 | Australia | 417/471 |
| 313189 | 12/1933 | Italy | 417/259 |

*Primary Examiner*—Ronald H. Lazarus

*Attorney, Agent, or Firm*—Robert J. Outland

[57] ABSTRACT

An engine driven vacuum pump combining a two-stage, low noise demountable pump assembly with a camshaft driven eccentric drive arrangement having internal oil distribution and pumping means for lubricating the drive and pump pushrod elements. A check valve in the cover of the pump assembly defines a second stage pumping chamber which increases pump efficiency while at the same time cyclically closing the pump outlet to reduce external noise attributable to gas discharge from the primary pumping chamber.

3 Claims, 6 Drawing Figures

ENGINE DRIVEN VACUUM PUMP

This invention relates to vacuum pumps and, more particularly, to a vehicle engine mounted vacuum pump arrangement to provide a source of vacuum for driving vacuum motors and actuators in vehicles having engines, such as diesel engines, which do not otherwise provide a ready or adequate vacuum source.

The development of diesel engines for optional use in place of conventional gasoline engines as prime movers in automotive passenger cars and trucks has brought a need for provision of a suitable source of vacuum for operating vehicle mounted accessories having vacuum motors and actuators which are normally arranged to operate from the vacuum developed in the intake manifold of the conventional gasoline engine.

The present invention provides a diesel engine mounted vacuum pump arrangement capable of acting as a vacuum source for driving such vehicle accessories and arranged to be mounted and make use of drive provisions within the engine which are equivalent to means for driving the distributor of a comparable model of gasoline fueled engine.

The arrangement includes a reciprocating piston pump having novel features to provide high efficiency with low noise output. Means for mounting and driving the pump are also included which take up and distribute internal engine lubricant for lubricating the drive mechanism and pump pushrod.

These and other features of the invention will be more fully understood from the following description of a preferred embodiment taken together with the accompanying drawings in which.

Figure 1:
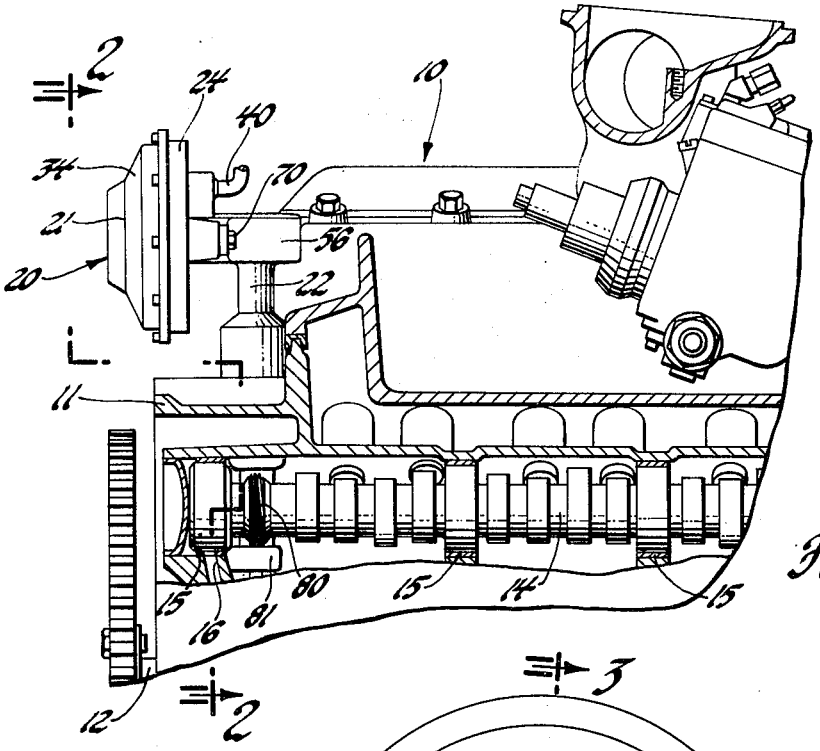
FIG. 1 is a fragmentary cross-sectional view of a diesel engine incorporating a vacuum pump and drive means in accordance with the invention.

Referring now to the drawings in detail, numeral 10 generally indicates an internal combustion engine of the automotive diesel type having a general arrangement like that of the engine disclosed in the co-pending United States Application for Patent entitled "Internal Combustion Engine," Ser. No. 710,923, filed Aug. 2, 1976 in the name of Lloyd T. Gill and assigned to the assignee of the present invention.

Engine 10 includes an engine block 11 rotatably supporting a crankshaft 12 which in turn drives, through conventional means not shown, a camshaft 14 supported in bearings 15 within the enclosed portion of the crankcase defined by the engine block. Oil passages 16, 18 in the block and camshaft, respectively, form a part of the engine pressure lubricating oil system used to lubricate the cam-shaft bearings and other internal moving parts of the engine.

Near one end of the engine block 11 there is mounted a vacuum pump and drive assembly 20 formed according to the invention and adapted to provide a source of vacuum for operating the various vacuum motors and actuators utilized in a vehicle in which the engine may be mounted. The use of a separate pump for this purpose is required, since a diesel engine of the type disclosed does not generate any significant amount of vacuum in operation and thus does not provide a significant source of vacuum, as do comparable throttled spark ignition engines for which the present diesel engine might be an optional replacement. Pump and drive assembly 20 is actually made up of two separable components, a pump assembly 21 and a mounting and drive assembly 22 which supports and drives the pump.

Figure 3:
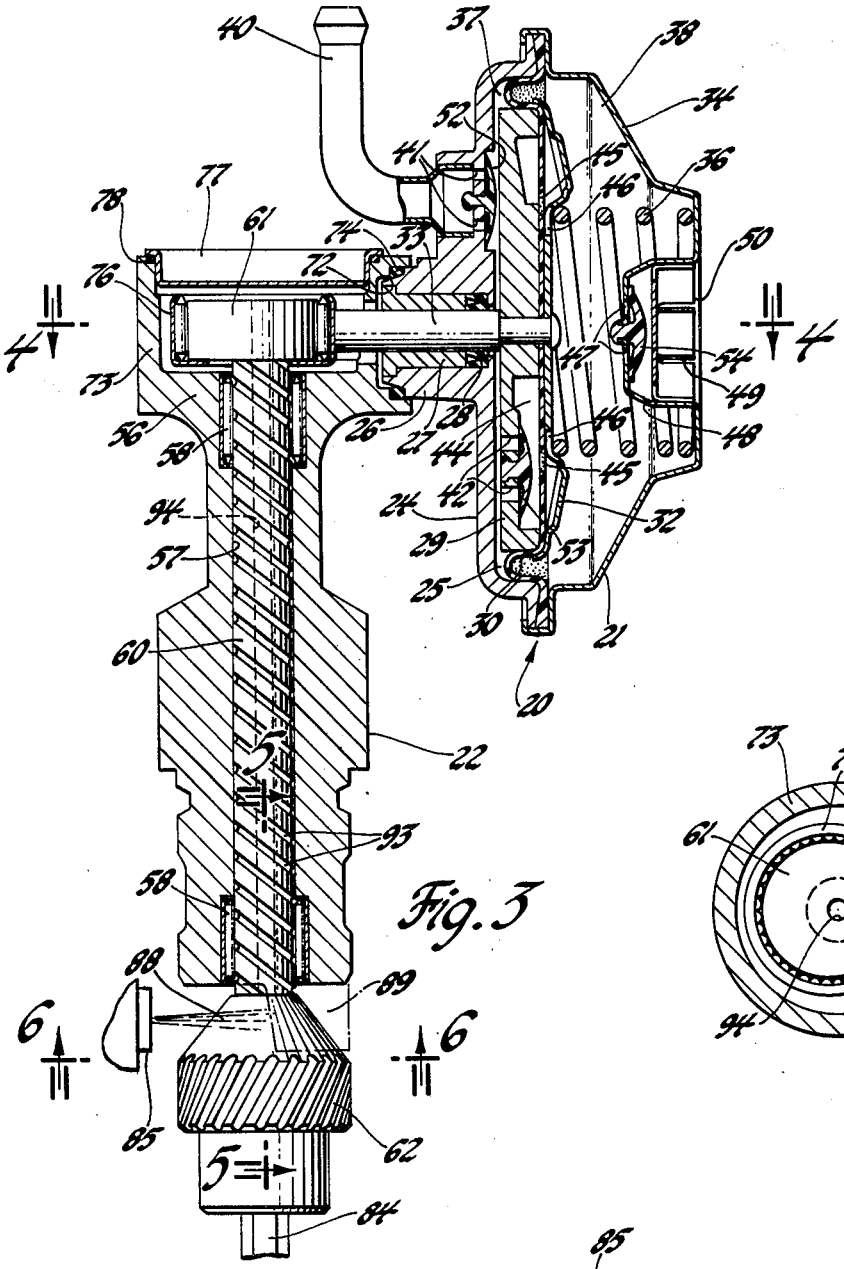
FIG. 3 is a cross-sectional view of the pump and drive assemblies shown in FIGS. 1 and 2 taken in the plane of the line 3—3 of FIG. 2 as viewed in the direction of the arrows.
Figure 4:
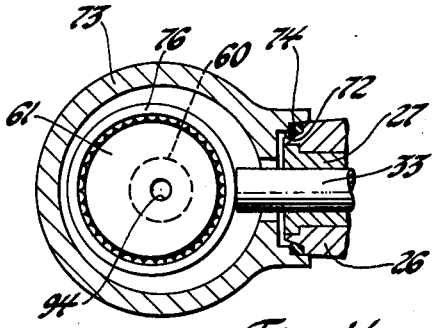
FIG. 4 is a fragmentary cross-sectional view of the drive arrangement as viewed from the plane of the line 4—4 of FIG. 3.
Figure 5:
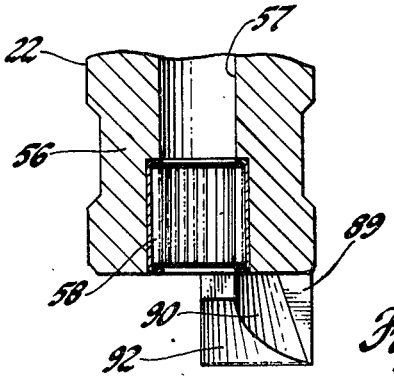
FIG. 5 is a fragmentary cross-sectional view of the lower end of the pump drive housing with the shaft and gear removed as seen from the plane indicated by the line 5—5 of FIG. 3 looking in the direction of the arrows.
Figure 6:
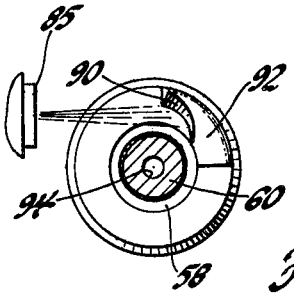
FIG. 6 is a bottom view from the plane indicated by the line 6—6 of FIG. 3 showing the lower end of the drive housing and shaft arrangement with the gear removed.

The construction of the pump assembly 21 is best shown in the cross-sectional view of FIG. 3. The pump includes a die cast aluminum base 24 defining a piston cavity 25 and having a nose portion 26 with a pressed-in hollow bushing 27 which traps a pushrod seal 28. Reciprocably carried in the base 24 is a piston assembly including a die cast aluminum piston member 29 carrying a rolling diaphragm type seal 30 and a combination diaphragm retainer and spring seat 32, all of which are retained together by a pushrod member 33 which extends through the piston diaphragm and retainer members and the hollow bushing 27 to the exterior of the base 24.

A cover member 34 is crimped to the edges of the base 24, engaging and retaining the rolling seal 30 in position. The cover also encloses the piston assembly and retains a coil spring 36 which engages the cover 34 and the retainer and spring seat member 32, biasing the piston assembly toward the piston cavity 25 of the base 24.

The base 24 and cover 34 together define a housing forming an enclosure which the piston assembly 29, 30, 32, 33 divides into a first or primary pumping chamber 37 and a discharge chamber or second pumping chamber 38. The piston assembly reciprocates within the enclosure, varying the volumes of chambers 37 and 38 in inverse fashion. The clearance volume (least volume) of the primary pumping chamber is made as small as possible by arranging for a very limited clearance to exist between the piston member 29 with its associated rolling seal 30 and the base 24 when the piston is in its retracted position, the furthest leftward position as shown in FIG. 3. The clearance volume (least volume) of the discharge chamber 38 is not nearly so small, since this chamber provides additional volume for retaining the spring 36, as well as other clearance increasing features resulting from the design of the piston, retainer and cover members.

The passage of air, or other vacuum fluid, through the pump follows a path through an inlet connector tube 40 mounted in the base 24 and inlet ports 41 through the base to the primary pumping chamber 37. From this chamber, the continued flow is through transfer ports 42 in piston 29 to an annular recess 44 under the diaphragm and thence through openings 45 provided in the central portion of the diaphragm and openings 46 in the retainer member 32 to the discharge chamber 38. From the discharge chamber, the fluid passes through discharge ports 47 provided in a central recessed portion 48 of the cover member 34 and out between indentations 49 in a protective baffle member 50 and the surrounding walls of the cover recess to the exterior of the pump.

The direction of airflow through the pump, upon reciprocation of the piston assembly, is determined by three check valves, 52, 53 and 54, mounted respectively in the base 24, piston 29 and cover 34 and controlling airflow through the inlet ports 41, transfer ports 42 and discharge ports 47, respectively. These valves allow fluid flow only in the direction above described and not in the opposite direction. Thus, reciprocation of the pump piston assembly by suitable drive means to be subsequently described causes the pump to operate in the following manner.

An extending movement of piston member 29 to the right from the position shown in FIG. 3 increases the volume of the primary pumping chamber 37, drawing air from the inlet tube into the primary pumping chamber and reducing the pressure so as to create a vacuum in the primary chamber, as well as in the inlet tube and other enclosed chambers to which it may be attached. At the same time, the volume of the discharge chamber 38 is being reduced, forcing any air therein out the discharge openings 47 to the exterior of the pump. Check valve 53 remains closed during this movement, preventing reverse flow from chamber 38 to chamber 37.

The return (retracting) stroke of the piston, from its furthest rightward position to the position shown in FIG. 3, again increases the volume of chamber 38, while reducing to its minimum the volume of chamber 37. This movement thus reduces the pressure of the remaining fluid in chamber 38, check valve 54 closing automatically to prevent the backflow of atmospheric air into this chamber. At the same time, the pressure in chamber 37 increases, closing the inlet valve 52. The increasing air pressure in chamber 37 and the reducing air pressure in chamber 38 open check valve 53, and most of the air in chamber 37 passes through the transfer ports 42 to chamber 38 as chamber 37 approaches and reaches its least volume. Continuation of pump operation with another extending movement of the piston member causes a repetition of the process by drawing another fresh charge of air into chamber 37 and forcing the residual charge from chamber 38, as previously described.

It should be noted that the pump assembly 21 would operate to create vacuum in the desired manner without the presence of the cover mounted check valve 54, since an extending movement of the piston would draw air into the chamber 37 through the inlet ports and a retracting movement of the piston would force this air out of chamber 37 through the transfer ports 42, which is all that is necessary to provide normal vacuum pump operation. The small clearance volume of the chamber 37 is, of course, intentionally provided to obtain a high pumping efficiency for this primary pumping chamber. The result of this design is, however, that the discharge of air from the primary pumping chamber 37 through the transfer ports 42 and past the valve 53, diaphragm 30 and retainer member 32 creates a substantial noise which it is desirable to suppress. This could, no doubt, be accomplished by providing some sort of sound suppressing chamber or filter at the outlet of the pump.

The present invention, however, accomplishes the desired purpose in a manner which gives an additional added benefit. This result is obtained by the use of the third check valve 54, mounted in the cover member and controlling airflow and the passage of noise through the discharge ports 47. The use of this valve greatly reduces the observable noise level of the pump, apparently due to the fact that this valve closes the discharge ports 47 during the period of air discharge through the transfer ports 42, which creates the major noise problem. Thus, the sound is effectively muffled by being enclosed within chamber 38, which is not opened to atmosphere until after the end of the air transfer step when the piston begins to extend (move rightwardly) and force air out of chamber 38 to atmosphere. This latter pumping step is accompanied by a much lower level of noise than the transfer step, and thus the overall transmitted noise level of the pump is reduced by the presence of the check valve 54. One possible reason for the reduced noise level of the latter pumping step is that the much greater clearance (least) volume of chamber 38 than that of chamber 37 does not create the same kind of abrupt and rapid outflow of gas through the discharge ports 47 that is apparently created in the transfer ports 42 by the movement of the piston to the least volume position of chamber 37.

Besides accomplishing a substantial reduction of radiated noise level, the provision of the cover mounted third check valve 54 also has the effect of improving the output efficiency of the vacuum pump by providing, in effect, a second stage of pumping operation. Thus, even though the chamber 38 is not designed with sufficiently close clearance to reach the pumping efficiency level of the primary pumping chamber 37, the effectiveness of discharge of air from chamber 37 through the transfer ports 42 is increased by the fact that chamber 38 is at the same time reduced in pressure, due to the presence of valve 54 which prevents the entry of atmospheric air into chamber 37 during retraction of the pump piston. Thus, by the addition of valve 54, overall pump efficiency is somewhat increased through the provision of a second stage of pumping action, while at the same time the noise transmission from the pump is reduced.

Turning now to the mounting and drive assembly 22, its functions are to mount the pump, to provide reciprocating drive for the pushrod of the pump piston and to provide itself and the pump pushrod with adequate lubrication. The assembly 22 comprises an aluminum drive housing 56 having a vertical bore 57 and a pair of spaced needle bearings 58 rotatably supporting in the housing a drive shaft 60. An eccentric cam 61 is fixed on the upper end of the drive shaft and a drive gear 62 is fixed on its lower end.

Drive housing 56 is seated at its lower end in a tubular opening 64 provided in an upper wall of the engine block. A flat 65 provided on the protruding portion of the housing forms a lip 66 that is engaged by a clamp 68 held by a bolt 69 to retain the housing and pump assembly in the block. The arrangement is the same as retention means used for the distributor of a comparable gasoline engine, except that the narrow lip provided by the flat 65 locates the assembly in a relatively fixed orientation on its axis without permitting the rotational adjustment usually provided in distributor mountings.

At its upper end, the pump base 24 and drive housing 56 are secured together by bolts 70 secured in abutting portions of the two members, thereby holding the nose portion 26 of the pump base within a recess 72 provided in the enlarged upper end 73 of the drive housing 56. An o-ring seal 74 is provided to prevent oil leakage through the joint. The pump pushrod 33 extends through an opening within the recess 72 into the upper end of the drive housing where its end is urged by the pump spring 36 into engagement with the outer race of a cam bearing assembly 76 mounted on the eccentric cam 61. An end plug 77 and o-ring seal 78 close the upper end of the drive housing above the cam 61.

At the lower end of the drive housing, the gear 62 extends within the engine block into driving engagement with gear teeth 80 formed on the engine camshaft 14 so as to provide a rotational drive for the gear 62 and drive shaft 60. The bottom end of gear 62 seats against a thrust pad 81 in the engine block which takes the downward thrust generated between the camshaft and driveshaft gears. In its lower end, the gear 62 has a hexagonal opening 82 in which is received a hexagonal driveshaft 84 that extends downwardly into the engine block to drive the engine oil pump, not shown. This drive is accomplished in the same manner as is the oil pump drive in comparable gasoline engines.

Lubrication of the vacuum pump pushrod and the pump drive mechanism is accomplished as follows. Within the engine block there is provided a pipe plug 85 closing the end of one of the engine oil galleries, not shown, and having a central orifice 86 through which a spray of pressurized oil is delivered against a conical upper surface 88 of the gear 62 located directly above the gear teeth. Some of this oil is carried downwardly by gravity to lubricate the engaging teeth of the camshaft and pump gears. However, the bottom end of the drive housing 56 is provided with a downward protrusion 89 which extends into close proximity with the conical surface 88 in the quadrant of the gear immediately beyond the point of impingement of the oil spray thereon. Protrusion 89 has a trough-like cutout 90 which co-operates with a conical surface 92 closely approaching the conical gear surface to scoop some of the oil off the surface of the gear and lead it upwardly in a spiral motion to the outer surface of the drive shaft 60 that extends upwardly through the drive housing bore 57. The outer surface of the drive shaft is provided with double lead helical grooves 93 which, because of the close fit of the drive shaft within the bore 57 and bearings 58, act like a screw pump and move oil upwardly in the drive housing to the eccentric cam 61 mounted on its upper end. Here, the oil is thrown outwardly, lubricating the cam bearing 76 and the pump pushrod 73 in its bushing 26, the seal 28 preventing lubricating oil from being carried into the air passing through the vacuum pump. A return flow passage 94 is provided down the center of the drive shaft 60 by which excess oil is drained from the upper part of the drive housing to the interior of gear 62 from which it leaks out to the engine crankcase through the clearance around the hexagonal drive shaft 84 or through the grooves 93 in the pump drive shaft 60.

Figure 2:
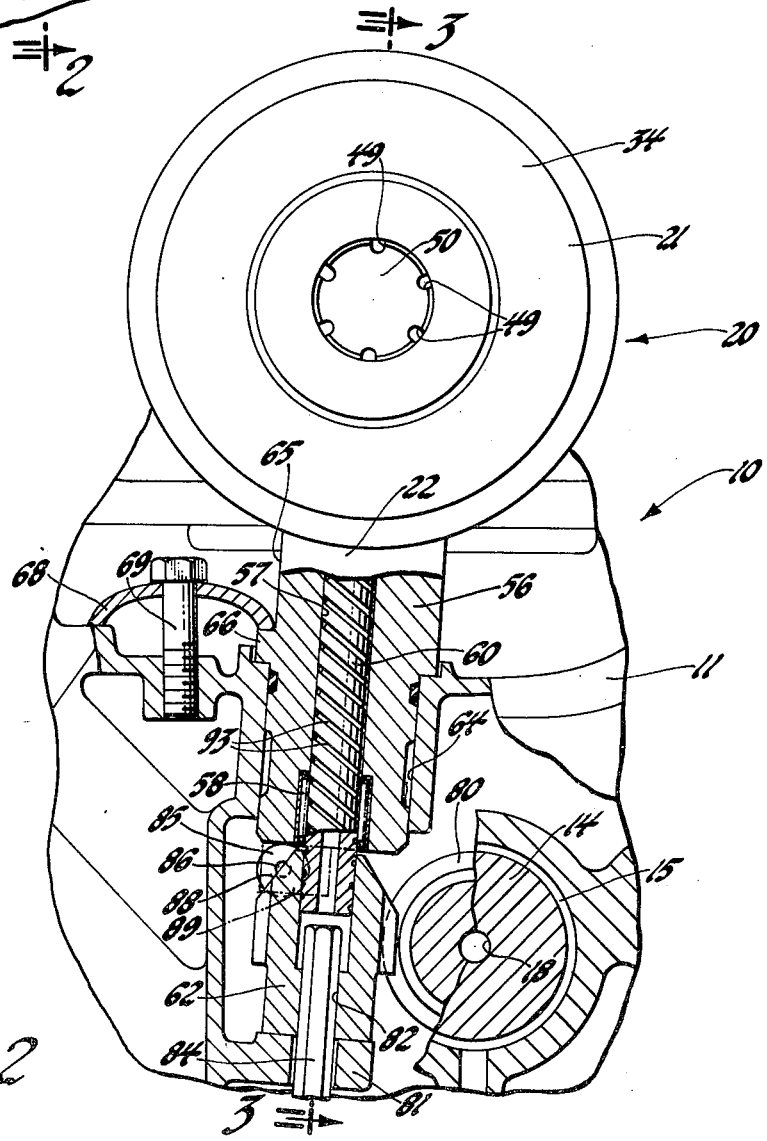
FIG. 2 is a partial cross-sectional view taken in the planes indicated by the line 2—2 of FIG. 1 and showing portions of the pump drive and lubrication system.

In operation of the drive assembly, rotation of the camshaft 14 counterclockwise, as seen in FIG. 2, causes rotation of the drive gear 62 and the pump shaft, thereby rotating the eccentric 61 and causing the outer race of the bearing assembly 76 to act in conjunction with the spring 36 of the pump to reciprocate the pushrod and piston assembly of the vacuum pump. This results in the efficient low noise vacuum pumping action described previously with respect to the vacuum pump assembly while, at the same time, lubrication of the rotating and reciprocating parts is provided in the manner just described.

While the invention has been described by reference to a preferred embodiment, it should be recognized that numerous changes might be made within the scope of the inventive concepts disclosed. Accordingly, it is intended that the invention not be limited, except in accordance with the language of the following claims.

What is claimed is:

1. A low noise two stage vacuum pump assembly comprising:

a housing containing a movable pumping member forming with the housing first and second stage pumping chambers which vary oppositely in volume on movement of the pumping member, a first check valve effective to admit gaseous vacuum fluid therethrough to the first chamber but to prevent reverse flow, a second check valve effective to permit flow therethrough from the first chamber to the second chamber but to prevent reverse flow, a third check valve effective to permit discharge flow therethrough from the second chamber to atmosphere but to prevent reverse flow, and means to alternately move said pumping member between two extreme positions to vary the volumes of said first and second chambers, thereby pumping gaseous fluid through the chambers to create a vacuum at the inlet of the first valve, said pumping member and said housing being shaped to provide almost no clearance in the first chamber at minimum volume to minimize the least volume of said first chamber so as to maximize the pumping effectiveness thereof but to provide a much greater clearance at minimum volume of the second chamber, resulting in a much greater least volume of said second chamber so as to reduce its pumping effectiveness compared to said first chamber, whereby said third valve is effective to reduce the noise of gaseous fluid exhaust from the pump while increasing its pumping efficiency by providing a second stage of pumping operation.

2. A low noise two stage vacuum pump assembly comprising:

a housing including a base and cover enclosing a reciprocable piston assembly defining with the base and cover, respectively, first and second stage pumping chambers, check valves in the base, the piston assembly and the cover and permitting gaseous fluid flow serially through these elements and the first and second stage pumping chambers while preventing flow in the reverse direction, a drive housing supporting the base at one end and having at its other end means for mounting the drive housing in an opening of an engine block, said drive housing having a drive shaft terminating in an eccentric at said one end, said eccentric engaging a pushrod extending from said piston assembly through said base to intermittantly force the piston assembly in one direction of motion upon rotation of the drive shaft, and spring means between the piston assembly and the cover urging the piston and pushrod toward the eccentric, thereby maintaining engagement and reciprocating the piston upon rotation of the drive shaft and eccentric, the piston and housing being shaped to provide almost no clearance in the first chamber at minimum volume to minimize the least volume of the first chamber so as to maximize its pumping effectiveness but to provide a much greater clearance at minimum volume of the second chamber, resulting in a much greater least volume of the second chamber so as to reduce its pumping effectiveness compared to said first chamber, whereby the cover mounted check valve is effective to reduct the noise of gaseous fluid exhaust from the pump while increasing its pumping efficiency by providng the second pumping stage.

3. The combination with an internal combustion engine of a low noise two stage vacuum pump assembly, said combination comprising:

a pump housing containing a movable pumping member forming with the housing first and second stage pumping chambers which vary oppositely in volume on movement of said pumping member, a first check valve effective to transmit gaseous vacuum fluid to the first chamber and prevent reverse flow, a second check valve effective to transmit fluid from the first chamber to the second chamber and prevent reverse flow, a third check valve effective to transmit gaseous fluid from the second chamber to atmosphere and prevent reverse flow, a drive housing supporting the pump housing at one end and having at its other end mounting means received in an opening of the block of said engine, said block having a rotatable engine driven shaft with a gear thereon said drive housing supporting a drive shaft connected at its lower end with a driven gear engaging the shaft gear and effective to rotate the drive shaft upon rotation of the engine driven shaft, an actuating cam supported on the upper end of said drive shaft and engaging a pushrod connected with the pumping member of the pump, said cam rotating with the drive shaft and being effective to reciprocate the pushrod and actuate the pumping member, and lubrication means for the pump drive and including means in the engine block to deliver a jet of lubricating oil onto the driven gear to lubricate said gear, the driven gear having an upwardly converging conical surface on which the oil jet impinges, a depending deflector member on the drive housing and extending close to the conical gear surface, said deflector being shaped to direct a portion of the oil on the conical surface up the conical surface to the drive shaft, said drive shaft extending upwardly with close clearance to opposed surface of the drive housing and having helical grooves effective to carry oil up the shaft to the eccentric on its other end, rotation of the eccentric in operation distributing the oil over the surfaces of the eccentric and the associated pump pushrod, whereby the pump drive mechanism is lubricated, and seal means in the pump housing and engaging the push rod to prevent the pump drive lubricant from entering the pumping chambers and check valves of the vacuum pump.

* * * * *